US008337642B2

(12) United States Patent
Fukuzumi et al.

(10) Patent No.: US 8,337,642 B2
(45) Date of Patent: Dec. 25, 2012

(54) SPRING STEEL WITH IMPROVED HARDENABILITY AND PITTING RESISTANCE

(75) Inventors: Tatsuo Fukuzumi, Tokyo (JP); Hidenori Hiromatsu, Utsunomiya (JP); Motoyuki Sato, Chiba (JP); Ryo Hara, Soka (JP)

(73) Assignee: Mitsubishi Steel Mfg. Co., Ltd., Tokyo (JP)

( * ) Notice: Subject to any disclaimer, the term of this patent is extended or adjusted under 35 U.S.C. 154(b) by 0 days.

(21) Appl. No.: 13/456,317

(22) Filed: Apr. 26, 2012

(65) Prior Publication Data

US 2012/0205013 A1 Aug. 16, 2012

Related U.S. Application Data

(62) Division of application No. 12/925,628, filed on Oct. 26, 2010, now Pat. No. 8,197,614, which is a division of application No. 10/515,134, filed as application No. PCT/JP03/14443 on Nov. 13, 2003, now Pat. No. 7,850,794.

(30) Foreign Application Priority Data

Nov. 21, 2002 (JP) ..... 2002-337655

(51) Int. Cl.
*C22C 38/00* (2006.01)
*C22C 38/32* (2006.01)

(52) U.S. Cl. ..... 148/332; 148/335; 420/91; 420/92; 420/93

(58) Field of Classification Search ..... 148/332, 148/335; 420/91, 92, 93
See application file for complete search history.

(56) References Cited

U.S. PATENT DOCUMENTS

| | | | |
|---|---|---|---|
| 5,186,768 | A | 2/1993 | Nomoto et al. |
| 6,322,747 | B1 | 11/2001 | Fukuzumi et al. |

FOREIGN PATENT DOCUMENTS

| | | |
|---|---|---|
| CA | 2 164 579 | 6/1996 |
| EP | 0 461 652 | 6/1991 |
| EP | 0 943 697 | 5/1998 |
| JP | 02-149645 | 6/1990 |
| JP | 2-149645 | 6/1990 |
| JP | 10-025537 | 1/1998 |
| JP | 11-152519 | 6/1999 |
| JP | 2001-234277 | 8/2001 |

*Primary Examiner* — Sikyin Ip
(74) *Attorney, Agent, or Firm* — Flynn, Thiel, Boutell & Tanis, P.C.

(57) ABSTRACT

The present invention provides a spring steel that has superior hardenability, undergoes less pitting in a corrosive environment, and can achieve higher stress and toughness. More specifically, the present invention provides a high-strength and high-toughness spring steel with improved hardenability and pitting resistance, containing, in mass percent, 0.40 to 0.70% carbon, 0.05 to 0.50% silicon, 0.60 to 1.00% manganese, 1.00 to 2.00% chromium, 0.010 to 0.050% niobium, 0.005 to 0.050% aluminum, 0.0045 to 0.0100% nitrogen, 0.005 to 0.050% titanium, 0.0005 to 0.0060% boron, no more than 0.015% phosphorus and no more than 0.010% sulfur, the remainder being composed of iron and unavoidable impurities, the steel having a tensile strength of at least 1700 MPa in 400° C. tempering after quenching and a Charpy impact value of at least 40 J/cm$^2$ for a 2 mm U-notched test piece of JIS Z 2202 and the parameter Fce being at least 1.70.

3 Claims, 3 Drawing Sheets

(a)

(b)

SPRING STEEL WITH IMPROVED HARDENABILITY AND PITTING RESISTANCE

This is a divisional of prior U.S. application Ser. No. 12/925,628, filed Oct. 26, 2010 now U.S. Pat. No. 8,197,614, which was a divisional of prior U.S. application Ser. No. 10/515,134, filed Nov. 17, 2004, now U.S. Pat. No. 7,850,794, which was the National Stage of International Application No. PCT/JP2003/014443, filed Nov. 13, 2003.

TECHNICAL FIELD

This invention relates to a spring steel having improved hardenability and pitting resistance coupled with a high toughness of at least 40 J/cm$^2$ in terms of impact value and a high strength of at least 1700 MPa in terms of tensile strength, even in a corrosive environment, when it used for suspension springs and leaf springs or the like in automobiles, or springs used in various types of industrial machinery and so on.

BACKGROUND ART

The spring steel used in the past for suspension springs, leaf springs, and so forth in automobiles, or in various types of industrial machinery and so on, was mainly JIS SUP11, SUP10, SUP9, SUP6, and steel equivalent to these, but the trend toward weight reduction in automobiles in recent years made it all the more important to reduce the weight of the springs themselves, which are suspension devices.

There has been a need for greater design stress to this end, and for the development of high-stress spring steel that can accommodate these higher stresses. Moreover, the need for higher hardness is particularly great with large-diameter suspension springs with a diameter of 30 mm or more and thick leaf springs with a thickness of 30 mm or more, and it is believed that this leads to a decrease in impact value and to spring breakage. It is known that higher spring stress increases sensitivity to hydrogen embrittlement cracking and the fatigue strength at which pitting occurs in a corrosive environment.

There are various types of steel in which hydrogen embrittlement resistance is increased through an increase in the fatigue life of spring steel (see Japanese Patent Publication 2001-234277, for instance), but no steel has yet to be developed that combines high stress with high toughness as in the present invention.

The present invention was conceived in light of the above prior art, and provides a spring steel that has superior hardenability, undergoes less pitting in a corrosive environment, and has a higher strength and toughness, even in large-diameter suspension springs with a diameter of 30 mm or more and thick leaf springs with a thickness of 30 mm or more.

DISCLOSURE OF THE INVENTION

The present invention is constituted by the following (1) to (3).

(1) A spring steel with improved hardenability and pitting resistance, comprising, in mass percent, 0.40 to 0.70% carbon, 0.05 to 0.50% silicon, 0.60 to 1.00% manganese, 1.00 to 2.00% chromium, 0.010 to 0.050% niobium, 0.005 to 0.050% aluminum, 0.0045 to 0.0100% nitrogen, 0.005 to 0.050% titanium, 0.0005 to 0.0060% boron, no more than 0.015% phosphorus and no more than 0.010% sulfur, the remainder being composed of iron and unavoidable impurities, the steel having a tensile strength of at least 1700 MPa in 400° C. tempering after quenching and a Charpy impact value of at least 40 J/cm$^2$ in a Charpy impact test specified in JIS Z 2242 for a 2 mm U-notched test piece according to JIS (Japanese Industrial Standard) Z 2202, wherein the parameter Fce= C %+0.15 Mn %+0.41 Ni %+0.83 Cr %+0.22 Mo %+0.63 Cu %+0.40 V %+1.36 Sb %+121 B % being at least 1.70.

(2) The spring steel with improved hardenability and pitting resistance according to (1) above, further comprising, in mass percent, one or two of 0.05 to 0.60% molybdenum and 0.05 to 0.40% vanadium.

(3) The spring steel with improved hardenability and pitting resistance according to (1) or (2) above, further comprising, in mass percent, one or more of 0.05 to 0.30% nickel, 0.10 to 0.50% copper, and 0.005 to 0.05% antimony.

The reasons for specifying the components as in the present invention are discussed below. All percentages are by mass.

C: Carbon is an element that is effective at increasing the strength of steel, but the strength required of spring steel will not be obtained if the content is less than 0.40%, whereas the spring will be too brittle if the content is over 0.70%, so the range is set at 0.40 to 0.70%.

Si: This is important as a deoxidation element, and the silicon content needs to be at least 0.05% in order to obtain an adequate deoxidation effect, but there will be a marked decrease in toughness if the content is over 0.50%, so the range is set at 0.05 to 0.50%.

Mn: Manganese is an element that is effective at increasing the hardenability of steel, and the content must be at least 0.60% in terms of both the hardenability and the strength of the spring steel, but toughness is impaired if the content is over 1.00%, so the range is set at 0.60 to 1.00%.

Cr: Chromium is an element that is effective at increasing pitting resistance and raising the strength of steel, but the required strength will not be obtained if the content is less than 1.00%, whereas toughness will suffer if the content is over 2.00%, so the range is set at 1.00 to 2.00%.

Nb: Niobium is an element that increases the strength and toughness of steel through a reduction in the size of the crystal grains and the precipitation of fine carbides, but this effect will not be adequately realized if the content is less than 0.010%, whereas if the content is over 0.050%, carbides that do not dissolve in austenite will excessively increase and deteriorate the spring characteristics, so the range is set at 0.010 to 0.050%.

Al: Aluminum is an element that is necessary in order to adjust the austenitic grain size and as a deoxidizer, and the crystal grains will not be any finer if the content is under 0.005%, but casting will tend to be more difficult if the content is over 0.050%, so the range is set at 0.005 to 0.050%.

N: Nitrogen is an element that bonds with aluminum and niobium to form AlN and NbN, thereby resulting in finer austenitic grain size, and contributes to better toughness through this increase in fineness. To achieve this effect, the content must be at least 0.0045%. However, it is better to add boron and minimize the amount of nitrogen used in order to achieve an increase in hardenability, and adding an excessive amount leads to the generation of bubbles at the ingot surface during solidification, and to steel that does not lend itself as well to casting. To avoid these problems, the upper limit must be set at 0.0100%, so the range is set at 0.0045 to 0.0100%.

Ti: This element is added in order to prevent the nitrogen in the steel from bonding with boron (discussed below) and forming BN, thereby preventing a decrease in the effect that boron has on improving pitting resistance, strengthening the grain boundary, and increasing hardenability. This will not happen if the titanium content is less than 0.005%, but if the added amount is too large, it may result in the production of large TiN that can become a site of fatigue failure, so the upper limit is 0.050% and the range is set at 0.005 to 0.050%.

B: Boron improves pitting resistance and also strengthens the grain boundary through precipitating as a solid solution near the grain boundary. This effect will not be adequately realized if the content is less than 0.0005%, but there will be no further improvement if 0.0060% is exceeded, so the range is set at 0.0005 to 0.0060%.

P: This element lowers impact value by precipitating at the austenite grain boundary and making this boundary more brittle, and this problem becomes pronounced when the phosphorus content is over 0.015%, so the range is set at no more than 0.015%.

S: Sulfur is present in steel as an MnS inclusion, and is a cause of shortened fatigue life. Therefore, to reduce such inclusions, the upper limit must be set at 0.010%, so the range is set at no more than 0.010%.

The above (2) is for a case in which a thick suspension spring or leaf spring is involved, and the reasons for specifying the molybdenum and vanadium contents are as follows.

Mo: Molybdenum is an element that ensures hardenability and increases the strength and toughness of the steel, but these effects will be inadequate if the content is less than 0.05%, whereas no further improvement will be achieved by exceeding 0.60%, so the range is set at 0.05 to 0.60%.

V: Vanadium is an element that increases the strength and hardenability of the steel, but the effect will be inadequate if the content is less than 0.05%, whereas if the content is over 0.40%, a carbide that does not dissolve in austenite will excessively increase and deteriorate the spring characteristics, so the range is set at 0.05 to 0.40%.

The above (3) is for a case in which corrosion resistance needs to be increased even further, and the reasons for specifying the nickel, copper, and antimony contents are as follows.

Ni: Nickel is an element required to increase the corrosion resistance of the steel, but the effect will be inadequate if the content is less than 0.05%, whereas the upper limit is set at 0.30% because of the high cost of this material, so the range is set at 0.05 to 0.30%.

Cu: Copper increases corrosion resistance, but its effect will not appear if the content is less than 0.10%, whereas problems such as cracking during hot rolling will be encountered if the content is over 0.50%, so the range is set at 0.10 to 0.50%.

Sb: Antimony increases corrosion resistance, but its effect will not appear if the content is less than 0.005%, whereas toughness will decrease if the content is over 0.05%, so the range is set at 0.005 to 0.050%.

With the present invention, carbon, manganese, nickel, chromium, molybdenum, boron, copper, vanadium, and antimony are used as the components for increasing hardenability and corrosion resistance, and the parameter Fce=C %+0.15 Mn %+0.41 Ni %+0.83 Cr %+0.22 Mo %+0.63 Cu %+0.40 V %+1.36 Sb %+121 B % is introduced in order to increase hardenability and corrosion resistance efficiently. Using the anti-pitting factor of the present invention facilitates component design.

The present invention provides spring steel in which the above-mentioned elements are within specific compositional ranges, which results in superior hardenability and less pitting, even in corrosive environments, and also results in lighter weight and higher stress and toughness.

BEST MODE FOR CARRYING OUT THE INVENTION

Figure 1:
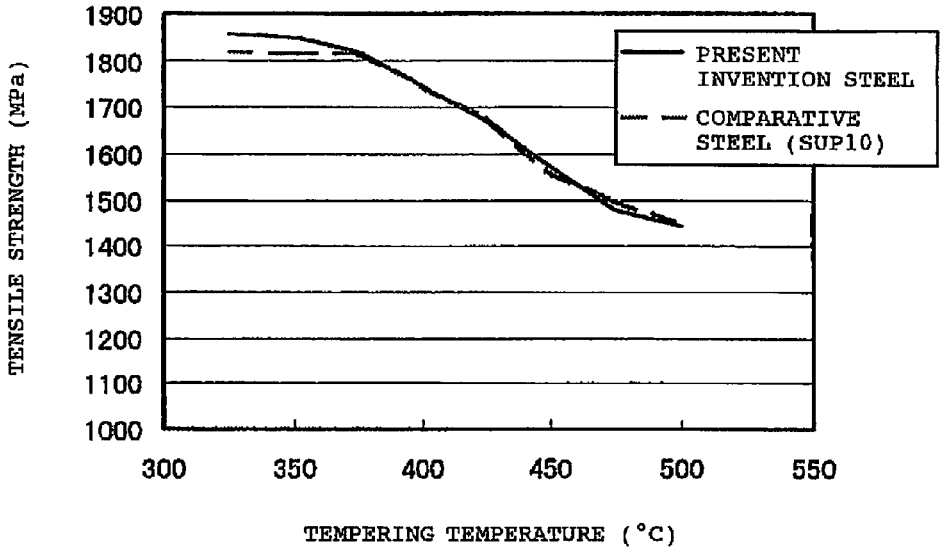
FIG. 1 is a graph of the test results for (a) tensile strength and (b) impact value of the present invention steel and comparative steel.
Figure 1:
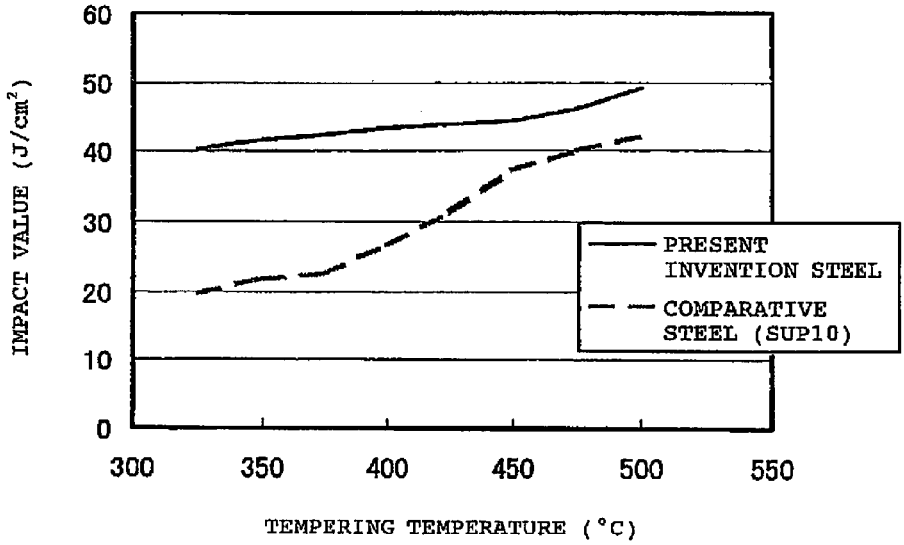

The present invention will now be described in further detail through specific examples. Table 1 shows the chemical components in the melts of an actual furnace for the steels of the present invention and comparative steels used for the sake of comparison. These steels in the actual furnace (electric furnace) are rolled into round bars with a diameter of 20 mm and were compared with the conventional steels.

TABLE 1

(mass %)

| | | C | Si | Mn | P | S | Ni | Cr | Mo | Cu | Sb | Al | V | Nb | Ti | B | N |
|---|---|---|---|---|---|---|---|---|---|---|---|---|---|---|---|---|---|
| Present | 1 | 0.53 | 0.19 | 0.78 | 0.007 | 0.003 | — | 1.19 | — | — | — | 0.027 | — | 0.019 | 0.026 | 0.0018 | 0.0086 |
| invention | 2 | 0.55 | 0.23 | 0.75 | 0.008 | 0.005 | — | 1.25 | — | — | — | 0.025 | — | 0.010 | 0.020 | 0.0015 | 0.0074 |
| steel 1 | 3 | 0.58 | 0.28 | 0.80 | 0.010 | 0.007 | — | 1.29 | — | — | — | 0.010 | — | 0.017 | 0.023 | 0.0017 | 0.0100 |
| | 4 | 0.56 | 0.27 | 0.73 | 0.006 | 0.008 | — | 1.15 | — | — | — | 0.050 | — | 0.020 | 0.026 | 0.0016 | 0.0072 |
| | 5 | 0.53 | 0.26 | 0.78 | 0.015 | 0.007 | — | 1.20 | — | — | — | 0.005 | — | 0.028 | 0.030 | 0.0014 | 0.0062 |
| | 6 | 0.40 | 0.43 | 0.82 | 0.004 | 0.010 | — | 2.00 | — | — | — | 0.025 | — | 0.020 | 0.050 | 0.0005 | 0.0045 |
| | 7 | 0.55 | 0.30 | 1.00 | 0.003 | 0.006 | — | 1.00 | — | — | — | 0.018 | — | 0.010 | 0.027 | 0.0019 | 0.0055 |
| | 8 | 0.51 | 0.50 | 0.82 | 0.007 | 0.005 | — | 1.25 | — | — | — | 0.016 | — | 0.018 | 0.045 | 0.0020 | 0.0062 |
| | 9 | 0.60 | 0.05 | 0.90 | 0.004 | 0.004 | — | 1.23 | — | — | — | 0.014 | — | 0.050 | 0.005 | 0.0060 | 0.0060 |
| | 10 | 0.70 | 0.45 | 0.60 | 0.009 | 0.003 | — | 1.01 | — | — | — | 0.018 | — | 0.010 | 0.028 | 0.0030 | 0.0050 |
| Present | 11 | 0.43 | 0.25 | 0.76 | 0.008 | 0.008 | — | 1.21 | 0.60 | — | — | 0.016 | — | 0.020 | 0.020 | 0.0019 | 0.0087 |
| invention | 12 | 0.56 | 0.30 | 0.75 | 0.007 | 0.005 | — | 1.10 | — | — | — | 0.020 | 0.40 | 0.023 | 0.030 | 0.0020 | 0.0090 |
| steel 2 | 13 | 0.54 | 0.20 | 0.80 | 0.005 | 0.006 | — | 1.18 | 0.32 | — | — | 0.025 | 0.05 | 0.018 | 0.034 | 0.0026 | 0.0075 |
| Present | 14 | 0.53 | 0.28 | 0.76 | 0.009 | 0.007 | 0.30 | 1.22 | — | — | — | 0.026 | — | 0.016 | 0.036 | 0.0015 | 0.0065 |
| invention | 15 | 0.51 | 0.27 | 0.75 | 0.010 | 0.006 | — | 1.26 | — | 0.50 | — | 0.025 | — | 0.020 | 0.025 | 0.0018 | 0.0085 |
| steel 3 | 16 | 0.65 | 0.26 | 0.61 | 0.008 | 0.000 | — | 1.21 | — | — | 0.050 | 0.018 | — | 0.015 | 0.027 | 0.0019 | 0.0074 |
| | 17 | 0.53 | 0.24 | 0.76 | 0.007 | 0.004 | 0.22 | 1.20 | — | 0.32 | — | 0.023 | — | 0.024 | 0.028 | 0.0024 | 0.0065 |
| | 18 | 0.54 | 0.26 | 0.70 | 0.009 | 0.007 | — | 1.21 | — | 0.25 | 0.043 | 0.021 | — | 0.026 | 0.030 | 0.0023 | 0.0048 |
| | 19 | 0.52 | 0.27 | 0.74 | 0.006 | 0.008 | 0.18 | 1.18 | — | — | 0.025 | 0.021 | — | 0.020 | 0.031 | 0.0018 | 0.0084 |
| | 20 | 0.55 | 0.24 | 0.76 | 0.005 | 0.003 | 0.14 | 1.17 | — | 0.32 | 0.020 | 0.028 | — | 0.021 | 0.027 | 0.0019 | 0.0082 |
| | 21 | 0.52 | 0.23 | 0.73 | 0.006 | 0.006 | 0.25 | 1.16 | 0.21 | 0.25 | — | 0.026 | — | 0.018 | 0.028 | 0.0020 | 0.0090 |
| | 22 | 0.51 | 0.26 | 0.76 | 0.008 | 0.009 | 0.25 | 1.20 | — | 0.26 | — | 0.024 | 0.35 | 0.019 | 0.029 | 0.0024 | 0.0087 |
| | 23 | 0.54 | 0.27 | 0.76 | 0.007 | 0.006 | — | 1.26 | 0.12 | — | 0.030 | 0.023 | 0.13 | 0.017 | 0.030 | 0.0028 | 0.0073 |

TABLE 1-continued

| | | (mass %) | | | | | | | | | | | | | | | |
|---|---|---|---|---|---|---|---|---|---|---|---|---|---|---|---|---|---|
| | | C | Si | Mn | P | S | Ni | Cr | Mo | Cu | Sb | Al | V | Nb | Ti | B | N |
| Comparative steel | SUP9 | 0.56 | 0.26 | 0.87 | 0.025 | 0.015 | 0.02 | 0.87 | 0.04 | 0.07 | — | 0.025 | — | — | — | — | 0.0108 |
| | SUP10 | 0.53 | 0.32 | 0.83 | 0.028 | 0.028 | 0.01 | 0.97 | 0.02 | 0.06 | — | 0.026 | 0.16 | — | — | — | 0.0235 |
| | SUP11 | 0.57 | 0.26 | 0.8 | 0.022 | 0.020 | 0.01 | 0.83 | 0.02 | 0.02 | — | 0.024 | — | — | 0.025 | 0.0015 | 0.0072 |
| | SUP7 | 0.59 | 2.07 | 0.83 | 0.030 | 0.020 | 0.01 | 0.15 | 0.01 | 0.03 | — | 0.027 | — | — | — | — | 0.0187 |

These rods were heat-treated as follows, after which tensile and impact test pieces were produced.

Test Piece Shape and Size

Tensile test piece: d=5 mmϕ

Impact test piece: 2 mm U-shaped test piece according to JIS Z 2202

Heat Treatment Conditions

Quenching: 20 minutes at 950° C., followed by oil quenching

Tempering: 60 minutes at 400° C., followed by air quenching

Figure 2:
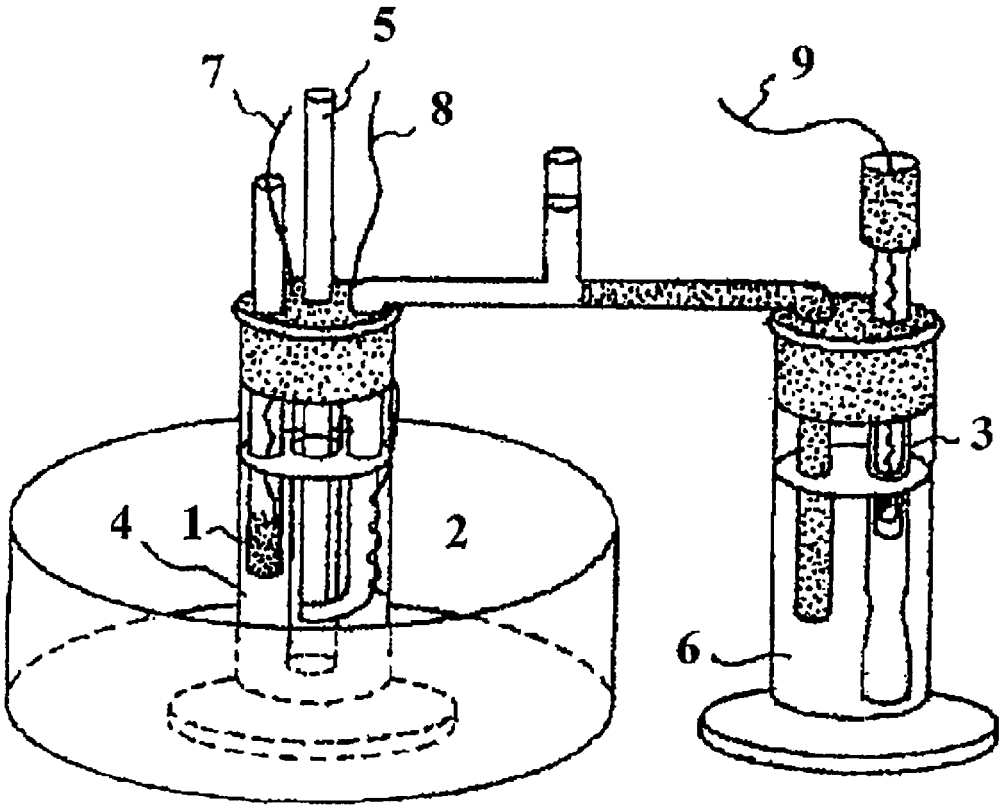
FIG. 2 is a diagram of the apparatus used to measure the pitting potential on a polarization curve.
Figure 3:
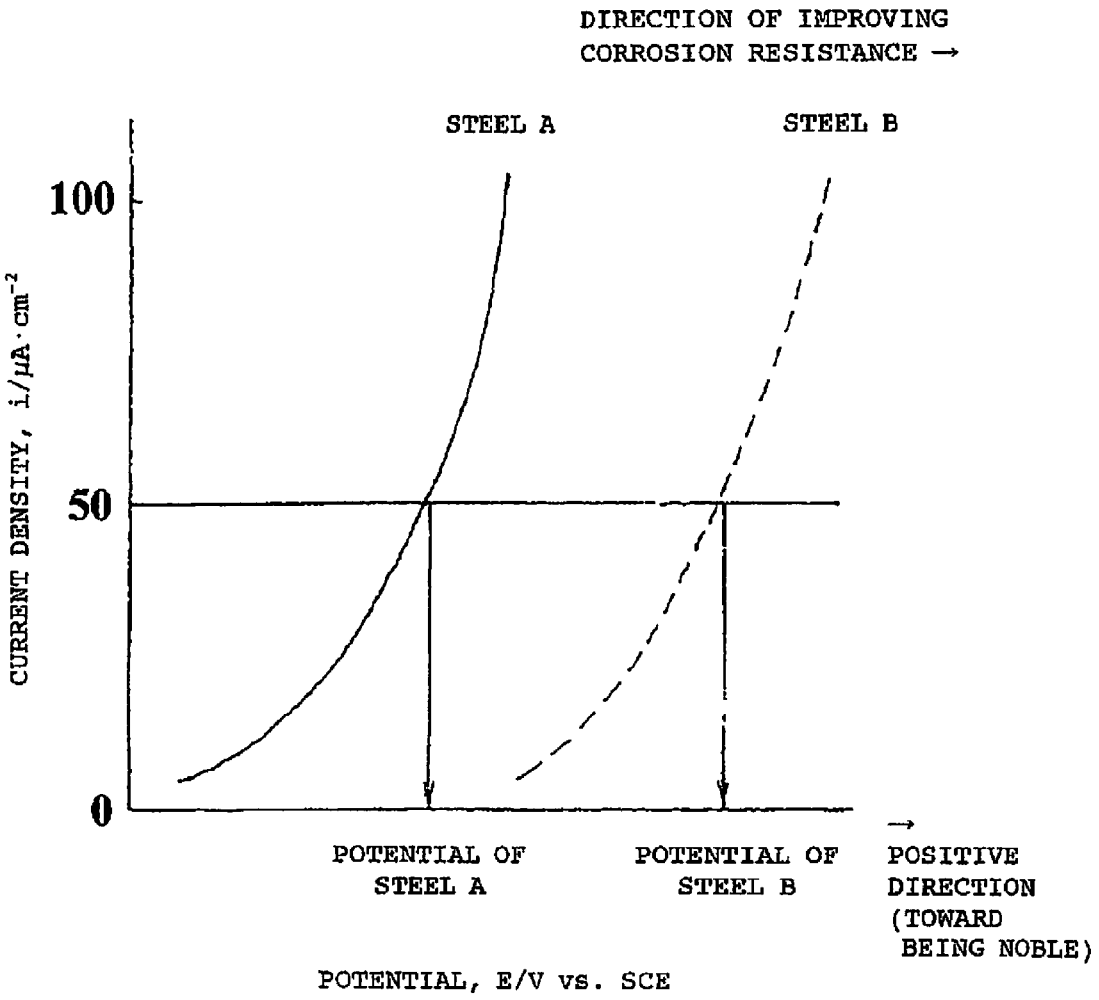
FIG. 3 is a graph of an example of measuring with the pitting potential measurement apparatus.

Table 2 shows the results of these tests. The austenitic grain sizes in the table are A.G.S. numbers.

potential. The results are given in Table 2. For the sake of reference, the apparatus used to measure the pitting potential on a polarization curve is shown in FIG. 2. In this figure, 1 is a sample, 2 is a platinum electrode, and 3 is a saturated calomel electrode. 4 is a 5% NaCl aqueous solution, a pipe 5 is connected to a nitrogen cylinder, and the oxygen (O) in the solution is removed by deaerating for 30 minutes and allowing the solution to stand for 40 minutes. 6 contains saturated KCl. 7, 8, and 9 are leads connected to an automatic polarization measurement apparatus. FIG. 3 is a graph of a measurement example. In FIG. 3, steel B exhibits a higher potential than steel A, indicating that steel B has superior corrosion resistance.

TABLE 2

| | | Tensile strength (MPa) | Impact value (J/cm$^2$) | Austenitic grain size (No.) | Hardenability J30 (HRC) | Pitting potential E (V) | Parameter Fce |
|---|---|---|---|---|---|---|---|
| Present invention steel 1 | 1 | 1711 | 43 | 8.0 | 57 | −0.66232 | 1.85 |
| | 2 | 1752 | 42 | 8.0 | 59 | −0.66417 | 1.88 |
| | 3 | 1808 | 42 | 8.5 | 59 | −0.66323 | 1.98 |
| | 4 | 1764 | 42 | 8.5 | 58 | −0.66223 | 1.82 |
| | 5 | 1731 | 43 | 8.0 | 58 | −0.66432 | 1.81 |
| | 6 | 1719 | 47 | 8.0 | 56 | −0.65231 | 2.24 |
| | 7 | 1715 | 43 | 8.0 | 59 | −0.66323 | 1.76 |
| | 8 | 1772 | 46 | 8.0 | 58 | −0.65023 | 1.91 |
| | 9 | 1788 | 40 | 8.5 | 59 | −0.66102 | 2.48 |
| | 10 | 1904 | 40 | 8.0 | 58 | −0.65713 | 1.99 |
| Present invention steel 2 | 11 | 1888 | 47 | 8.0 | 62 | −0.66432 | 1.91 |
| | 12 | 1864 | 40 | 8.0 | 60 | −0.65321 | 1.99 |
| | 13 | 1896 | 43 | 8.0 | 62 | −0.65321 | 2.04 |
| Present invention steel 2 | 14 | 1772 | 44 | 8.0 | 58 | −0.63732 | 1.96 |
| | 15 | 1756 | 43 | 8.5 | 57 | −0.63431 | 2.20 |
| | 16 | 1828 | 40 | 8.0 | 59 | −0.63118 | 2.04 |
| | 17 | 1752 | 43 | 8.0 | 57 | −0.63422 | 2.22 |
| | 18 | 1748 | 43 | 8.0 | 57 | −0.62187 | 2.14 |
| | 19 | 1735 | 44 | 8.0 | 57 | −0.63871 | 1.94 |
| | 20 | 1764 | 42 | 8.0 | 58 | −0.63471 | 2.15 |
| | 21 | 1864 | 45 | 8.0 | 60 | −0.63126 | 2.14 |
| | 22 | 1824 | 41 | 8.0 | 60 | −0.62731 | 2.32 |
| | 23 | 1844 | 42 | 8.0 | 62 | −0.62187 | 2.16 |
| Comparative steel | SUP9 | 1731 | 19 | 8.0 | 37 | −0.67321 | 1.47 |
| | SUP10 | 1752 | 21 | 7.0 | 43 | −0.66983 | 1.57 |
| | SUP11 | 1765 | 22 | 6.0 | 51 | −0.66826 | 1.59 |
| | SUP7 | 1735 | 25 | 6.0 | 32 | −0.68211 | 0.86 |

As is clear from Table 2, the present invention steel exhibited a high impact value of at least 40 J/cm$^2$ even at a tensile strength of 1700 MPa or higher. This can be attributed to grain boundary strengthening and crystal grain size refinement. FIGS. 1(*a*) (tensile strength) and 1(*b*) (impact value) show the results of comparing the tempering performance curve of SUP10 as a comparative steel with that of No. 5 of the present invention steel 1 in order to confirm the same effect. It can also be seen from these graphs that the present invention steel has a higher toughness value than the comparative steel.

To confirm the corrosion resistance of the present invention, a saturated calomel electrode was used to evaluate the corrosion resistance at a current density of 50 μA/cm$^2$ by measuring the polarization characteristics in terms of pitting A comparison of the pitting potentials in Table 2 indicates that the present invention steel is closer to having a positive value, that is, is more noble, and the present invention steel has better corrosion resistance than the comparative steel.

Table 2 shows the results of a hardenability test conducted according to JIS G 0561, known as Jominy end quenching method. In a comparison, at a quenching distance J, 30 mm, the present invention steel exhibited a higher value than the comparative steel, and in particular, the present invention steel 2 to which molybdenum and vanadium were added exhibited an extremely high hardenability of HRC 60 to 62.

To confirm the better corrosion resistance of present invention steel 3, a comparison of the pitting potentials in Table 2 reveals that the present invention steel 3, to which nickel, copper, and antimony were added, is closer to having a positive value, that is, is more noble, than the present invention steels 1 and 2. Specifically, this indicates that the present invention steel to which nickel, copper, and antimony were added has better corrosion resistance than the present invention steels 1 and 2.

INDUSTRIAL APPLICABILITY

As described above, spring steels according to the present invention have superior hardenability, undergo less pitting in a corrosive environment, and have higher tensile strength and toughness, which contribute to reducing the weight of a spring.

What is claimed is:

1. A spring steel with improved hardenability and pitting resistance, consisting of, in mass percent, 0.40 to 0.70% carbon, 0.05 to 0.50% silicon, 0.60 to 1.00% manganese, 1.00 to 2.00% chromium, 0.010 to 0.050% niobium, 0.005 to 0.050% aluminum, 0.0045 to 0.0100% nitrogen, 0.005 to 0.050% titanium, 0.0005 to 0.0060% boron, no more than 0.015% phosphorus and no more than 0.010% sulfur, the remainder being composed of iron and unavoidable impurities, the steel having a tensile strength of at least 1700 MPa in 400° C. tempering after quenching and a Charpy impact value of at least 40 J/cm$^2$ in a Charpy impact test specified in JIS Z 2242 for a 2 mm U-notched test piece according to JIS Z 2202, wherein the parameter Fce=C %+0.15 Mn %+0.41 Ni %+0.83 Cr %+0.22 Mo %+0.63 Cu %+0.40 V %+1.36 Sb %+121 B % is at least 1.70.

2. A spring steel with improved hardenability and pitting resistance consisting of, in mass percent, 0.40 to 0.70% carbon, 0.05 to 0.50% silicon, 0.60 to 1.00% manganese, 1.00 to 2.00% chromium, 0.010 to 0.050% niobium, 0.005 to 0.050% aluminum, 0.0045 to 0.0100% nitrogen, 0.005 to 0.050% titanium, 0.0005 to 0.0060% boron, no more than 0.015% phosphorus, no more than 0.010% sulfur, 0.05 to 0.60% molybdenum and 0.05 to 0.40% vanadium, the remainder being composed of iron and unavoidable impurities, the steel having a tensile strength of at least 1700 MPa in 400° C. tempering after quenching and a Charpy impact value of at least 40 J/cm$^2$ in a Charpy impact test specified in JIS Z 2242 for a 2 mm U-notched test piece according to JIS Z 2202, wherein the parameters Fce=C %+0.15 Mn %+0.41 Ni %+0.83 Cr %+0.22 Mo %+0.63 Cu %+0.40 V %+1.36 Sb %+1.21 B % is at least 1.70.

3. A spring steel with improved hardenability and pitting resistance consisting of, in mass percent, 0.40 to 0.70% carbon, 0.05 to 0.50% silicon, 0.60 to 1.00% manganese, 1.00 to 2.00% chromium, 0.010 to 0.050% niobium, 0.005 to 0.050% aluminum, 0.0045 to 0.0100% nitrogen, 0.005 to 0.050% titanium, 0.0005 to 0.0060% boron, no more than 0.015% phosphorus, no more than 0.010% sulfur, and 0.05 to 0.40% vanadium, the remainder being composed of iron and unavoidable impurities, the steel having a tensile strength of at least 1700 MPa in 400° C. tempering after quenching and a Charpy impact value of at least 40 J/cm$^2$ in a Charpy impact test specified in JIS Z 2242 for a 2 mm U-notched test piece according to JIS Z 2202, wherein the parameter Fce=C %+0.15 Mn %+0.41 Ni %+0.83 Cr %+0.22 Mo %+0.63 Cu %+0.40 V %+1.36 Sb %+121 B % is at least 1.70.

* * * * *